US006105765A

United States Patent [19]

Chu

[11] Patent Number: 6,105,765

[45] Date of Patent: Aug. 22, 2000

[54] PACKAGE CASE FOR ELECTRIC APPLIANCES AND COMPUTERS

[76] Inventor: Cheng-Kang Chu, No. 228, Niu Pu South Road, Hsin Chu, Taiwan

[21] Appl. No.: 09/342,199

[22] Filed: Jun. 29, 1999

[51] Int. Cl.[7] ..... B65D 85/00

[52] U.S. Cl. ..... 206/320; 206/592; 206/564

[58] Field of Search ..... 206/320, 576, 206/591, 592, 564, 507

[56] References Cited

U.S. PATENT DOCUMENTS

| | | | |
|---|---|---|---|
| 3,471,116 | 10/1969 | De Cherrie | 206/320 |
| 4,398,212 | 8/1983 | Serry et al. | 206/320 |
| 4,828,115 | 5/1989 | Wiegand et al. | 206/576 |
| 5,226,543 | 7/1993 | Foos et al. | 206/592 |
| 5,385,232 | 1/1995 | Foos et al. | 206/521 |
| 5,515,976 | 5/1996 | Moren et al. | 206/586 |
| 5,692,618 | 12/1997 | Beak | 206/586 |
| 5,706,951 | 1/1998 | Oinuma et al. | 206/710 |
| 5,715,940 | 2/1998 | Son | 206/320 |
| 5,755,331 | 5/1998 | Watson | 206/586 |
| 5,779,045 | 7/1998 | Yu | 206/320 |

*Primary Examiner*—Paul T. Sewell
*Assistant Examiner*—Nhan T. Lam
*Attorney, Agent, or Firm*—Rosenberg, Klein & Lee

[57] ABSTRACT

The package case for electric appliances and computers consists of an upper case and a lower case made of a tough thin plastic plate formed to have four sides and a bottom, an hollow interior defined by the four sides and the bottom and having a shape to correspond to the shape of a product to be packaged. Each of the four sides has a sloped outer and inner wall, and a plurality of curved recesses formed in the sloped outer and the inner wall and in the top of each side. The hollow package case placed in a carton may have excellent shock-absorbing function to protect a product packaged therein from damage or hurt caused by shocks or lowering movement in transporting. It is of low cost, handy to handle, reducing pollution to the environment, and having enough shock-absorbing ability for protecting electric appliances and computers.

2 Claims, 7 Drawing Sheets

PACKAGE CASE FOR ELECTRIC APPLIANCES AND COMPUTERS

BACKGROUND OF THE INVENTION

This invention relates to a package case for electric appliance and computers, particularly to one light, hollow and protected by air cushion, possible to be piled up one by one to save dimensions for storing and transporting, taking place of a conventional Styrofoam packaging case.

A conventional package case for electric appliance and computers shown in FIGS. 6 and 7, is made of Styrofoam, including several lower cushions 12 and several upper cushions 14 sandwiching a product 13, and then put in a carton 11 to be sealed and then transported or stored.

This kind of package case has been used for many years, and found to have the following disadvantages.

1. Styrofoam is a kind of toxic package material, especially to human bodies when burned, making up a great threat to the environment.
2. Styrofoam lower and upper cushions generally have a thick wall with recessed portions for fitting a product, needing much material and polluting the environment when discarded after use.
3. Large molds are needed to inject the lower cushions and the upper cushions in manufacturing, aside from a large cost for the injecting machine, Styrofoam may produce odor during manufacturing process, affecting health of workers at the site and the neighbors.
4. Styrofoam easily absorbs water, causing negative influence to the products kept therein during a long period of storing and transporting, worsening the accuracy of the products and their service life.
5. Styrofoam may have various density, strength and hardness according to its weight, rather loose and soft to break to fall off when it is made of light weight, and too hard to absorb shocks to cause hurts or damage to products when it is made of heavy weight.
6. After products packaged in the cartons and the cases reach offices where the products are to be used, Styrofoam cases are taken out of the cartons. But they cannot be piled up one by one, taking considerable dimensions so they are disadvantageous to be transported or stored.
7. Four sides of the package case are flat and straight to tightly fit in the inner walls of a carton, with the friction coefficient being very high. So when a Styrofoam package case is placed in a carton for protecting a product, the air under the lower cushions in not easy to flow out, not permitting the bottom cushion easily reach the bottom of the carton. Therefore packaging may take much time, and if the packaging case is hurriedly pressed forcefully, the carton may be pushed by air to break, causing unnecessary troubles.
8. Excessive tightness between the package case and a carton may cause inconvenience of difficulty in taking a product off the packaging case, wasting time.
9. As the upper cushions have flat surfaces, accessories such as, a manual, a transformer, a wire cord, a plug, etc. are inserted randomly in gaps in a product, and chances are that accessories may have to be separately attached or thrown away together with the carton and the package case without knowing what are the accessories.

SUMMARY

The main objective of the invention is to offer a package case made of PP or PET by means of injecting molding process, having necessary recesses or gaps for a product to fit therein, consisting of an upper and a lower hollow case to fit four sides of a carton. Thus, when the package case and the carton completely wrap a product, hollow spaces are filled with so that the package case may have the function as if it had air cushions. Therefore, a computer or the like can be protected therein for a long period of time during transporting, without possibility of getting damaged by shocks, and lessening largely package material and its cost, decreasing influence to the environment, and thus increasing competitiveness of a maker.

Another objective of the invention is to offer a hollow package case, utilizing curved recesses formed in four sides as reinforcing means, enabling a very thin package case have enough strength and buffer elasticity to endure weight and shock in lowering movement during transporting, thus protecting precise products from damage or hurt to hold their precision and proper service life.

Another objective of the invention is to offer a package case for electric appliances and computers, having four sides having an outer and an inner wall provided with a plurality of curved recesses properly arranged to function as reinforcing means. So the package case may have air cushions enough in any sides, after it wraps up a product. And in placing it in a carton, it is enough that the lower edges of the four sides of the package case are pressed to force the air therein flow out easily, permitting the package case easily lowered down in the carton, quite advantageous in packaging.

One more objective of the invention is to offer a package case for electric appliances and computers, having a hollow body made of a tough thin material, not absorbing water to cause negative influence to electronic components or products during a long period of transportation, securing their proper service life. In addition, the upper hollow space in the upper case can be used for placing accessories such as a plug, batteries, a transformer, a manual, etc. with projecting portions preventing the accessories from moving around. Further, one of the side walls is provided with a cut line and a hole for the cord of an electric appliance or a computer to pass through and positioned beside the accessories to prevent them from moving around or falling off.

Further, the invention has considerable cold-resistant property for transportation in a very cold region, not producing cracks, securing safety and practicality of the package. Besides, its four sloped sides enable itself piled up one by one, lessening space for storing and transporting largely, thus saving cost for land needed by a maker.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
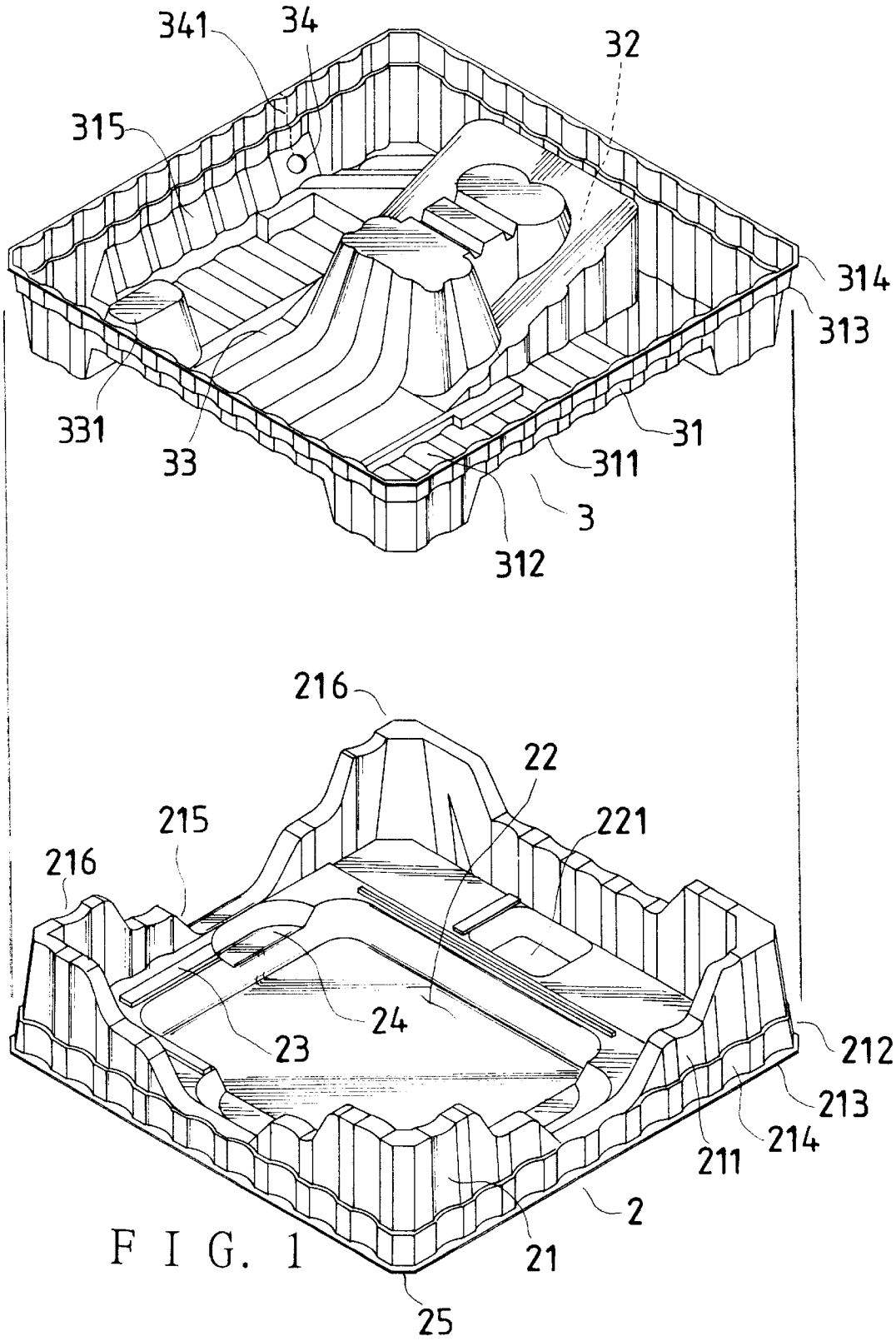
FIG. 1 is an exploded perspective view of a package case for electric appliances and computers of the present invention.

A preferred embodiment of a package case for electric appliances and computers of the present invention, as shown in FIG. 1, includes a lower case 2 and an upper case 3 wrapping around a product 13 and placed in a carton 11.

The lower case 2 is made integral of a tough thin material such as PP or PET by means of injecting molding process, having a hollow body, four sides 21 with a sloped inner and outer wall and a plurality of curved recesses 211 properly arranged in the sloped inner and outer wall of the four sides 21 to function as reinforcing means, an outer circumferential edge 212 formed with a step shape to further reinforce the hollow body, and a lowest circumferential edge 213 to suit to the inner size of a carton 11. Each side wall 21 further has a plurality of curved recesses 214 properly arranged under the curved recesses 211, and a large notch 215 in two opposite sides for fingers to extend through for holding a product with no openings. A projecting-up member 216 is respectively formed at top of every corner to increase structural strength. Further, the lower case 2 has a hollow interior 22 with proper recesses 221 to suit to the shape of a product to be packaged, and protruding-up strips 23 formed in each side of the bottom near the sides 21 for protecting fragile portions as a screen, glass components, etc. Further, a shallow curved recess 24 is respectively formed at two opposite locations in the bottom near each large notch 215 for fingers to extend in to hold a product placed on the lower case 2. Further, four corners of the lowest circumferential edge 213 are provided with an obtuse angle 25.

Figure 4:
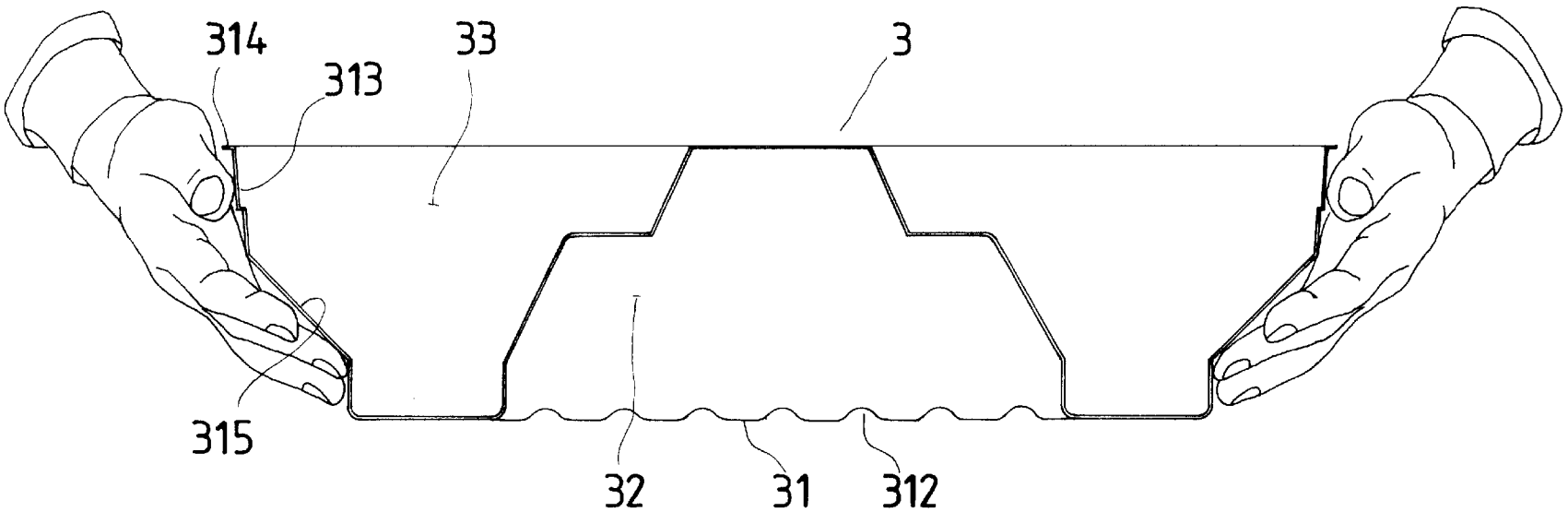
FIG. 4 is a side view of the package case held with two hands.
Figure 5:
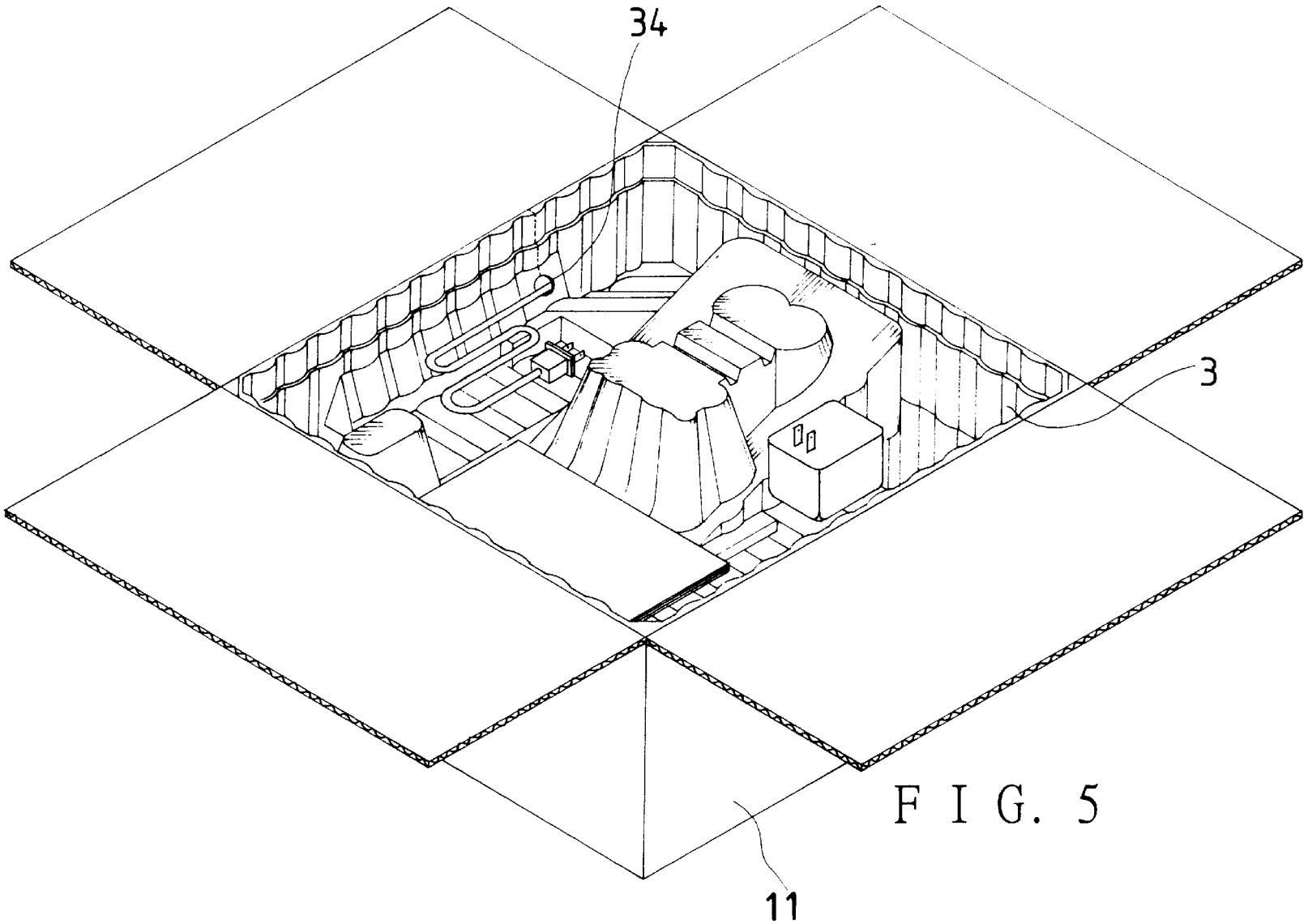
FIG. 5 is a perspective view of an upper case placed in a carton of the present invention.
Figure 6:
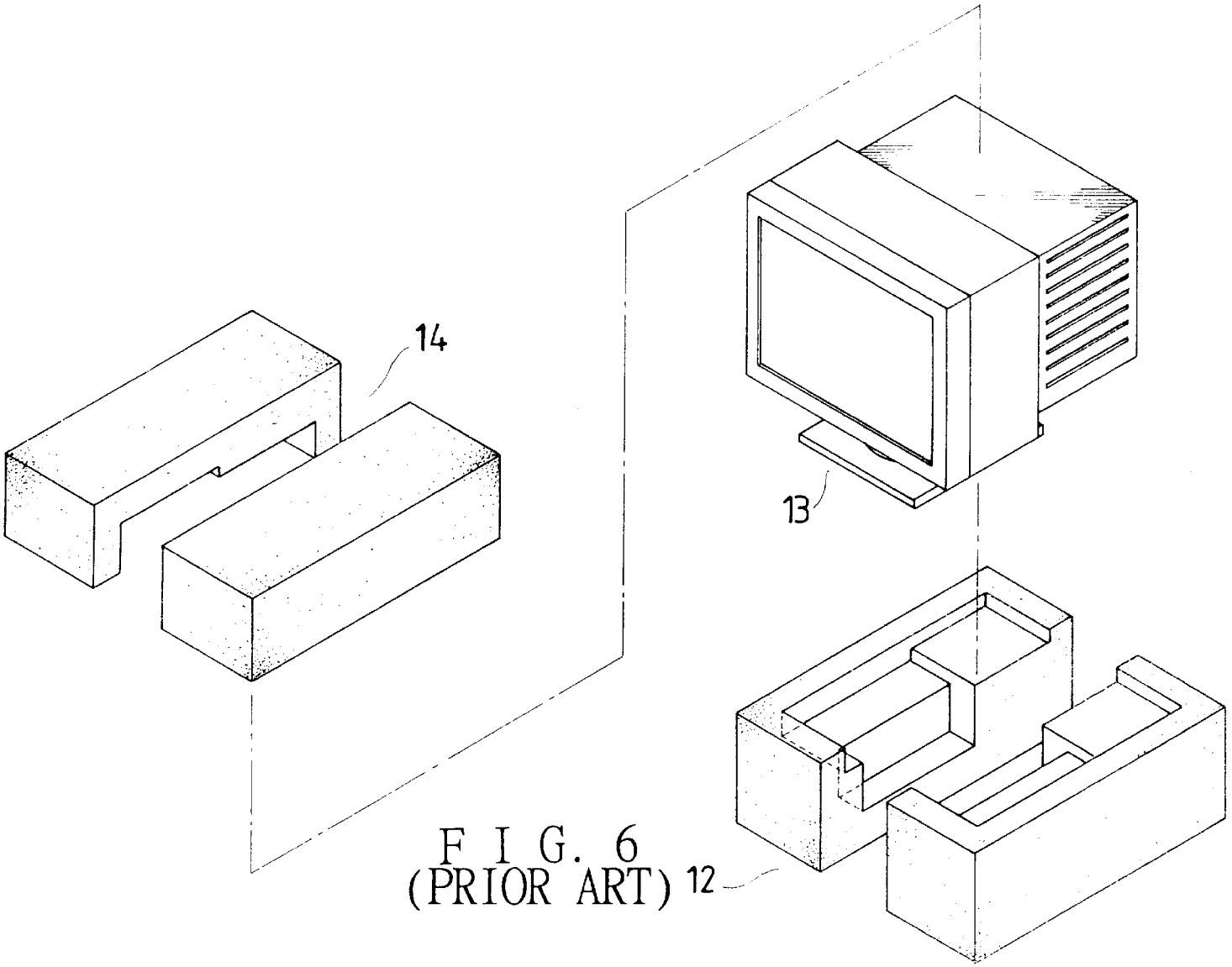
FIG. 6 (PRIOR ART)
FIG. 6 is an exploded perspective view of a conventional Styrofoam package case.
Figure 7:
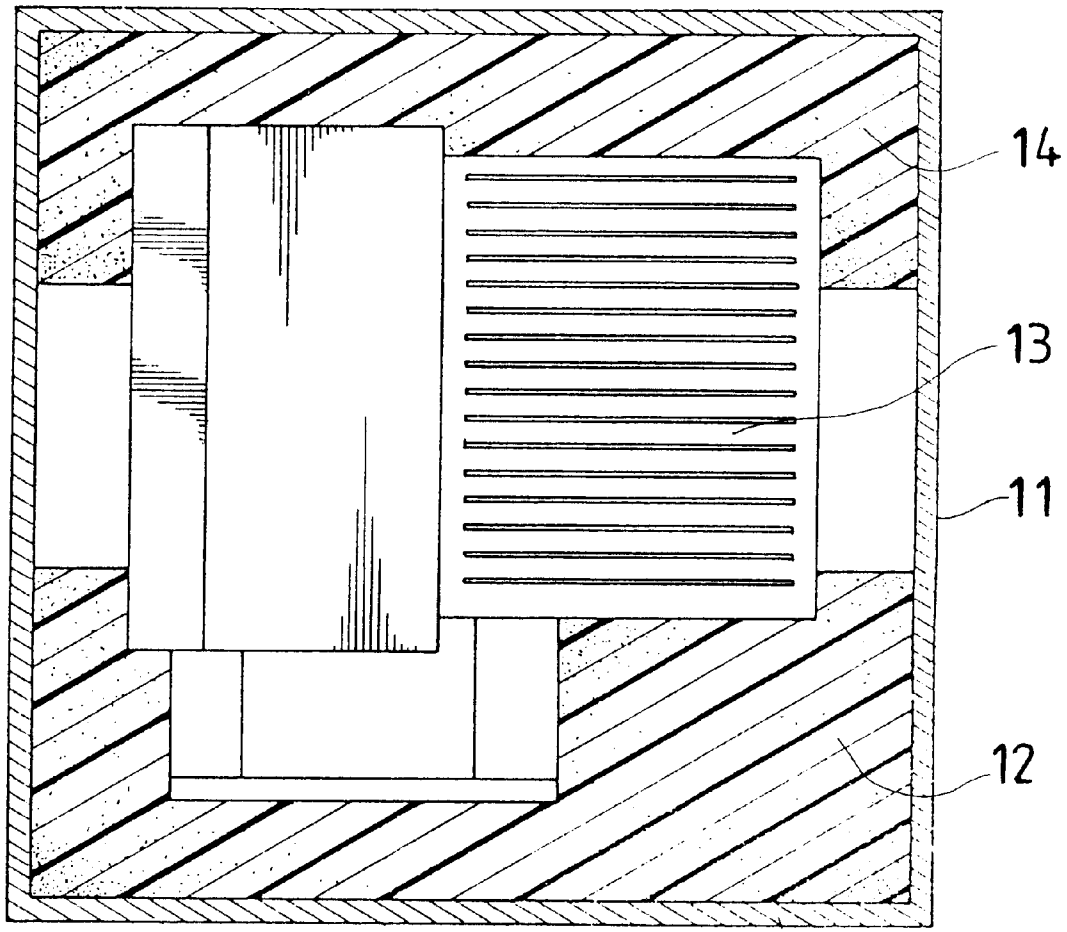
FIG. 7 (PRIOR ART)
FIG. 7 is a cross-sectional view of the conventional Styrofoam package case.

The upper case 3 has a shape to symmetrically correspond to the lower case 2, having four sides 31 extending downward and a bottom and a hollow interior 32 defined the four sides 31 and the bottom facing down. Each side 31 has a sloped outer and inner wall and a plurality of curved recesses 311 formed in the sloped outer and inner wall, a plurality of curved recesses 312 formed on the bottom near the four sides 31, and an outer circumferential edge 313 with a protruding edge 314. Further, a large sloped surface 315 is respectively formed on two opposite inner walls, reinforcing and giving buffer elasticity to the upper case 3 and for fingers to put on to hold the upper case 3, as shown in FIG. 4. An upper front hollow interior 33 is used for placing accessories such as a manual, a transformer, a cord, a plug, etc., with a large projection 331 formed near the front side 31 to keep the accessories from moving around and for convenience to be taken out, as shown in FIG. 5. Further, a hole 34 and a cut line 341 are provided in a side wall 31 for a wire cord of a product 13 to pass through and placed in the upper hollow interior 33 with other accessories. Every corner of the upper case 3 has an obtuse angle 35. Every curved recess 311 can be taken place with a projecting-out swell.

Figure 2:
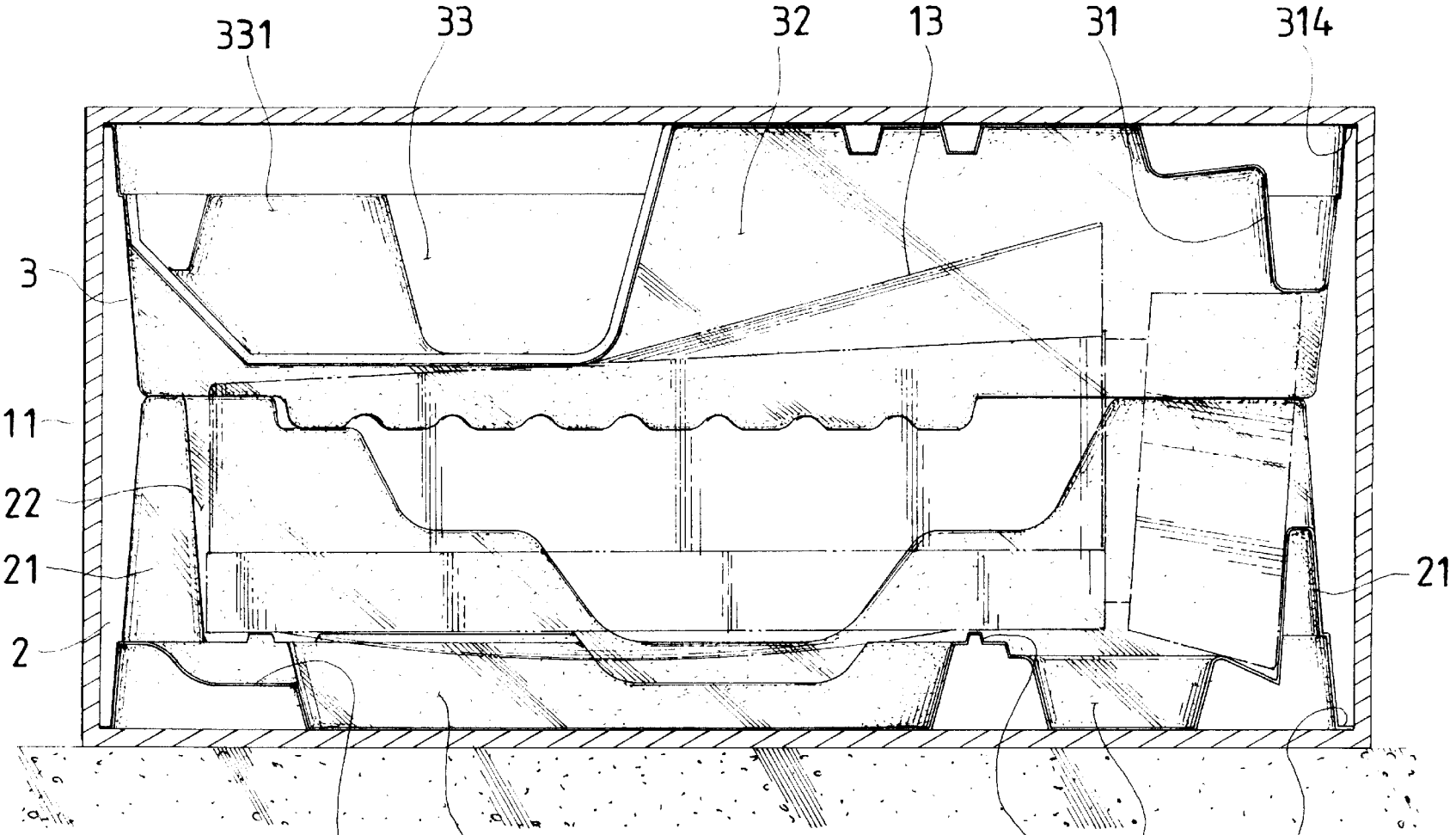
FIG. 2 is a cross-sectional view of the package case for electric appliances and computers of the present invention.
Figure 3:
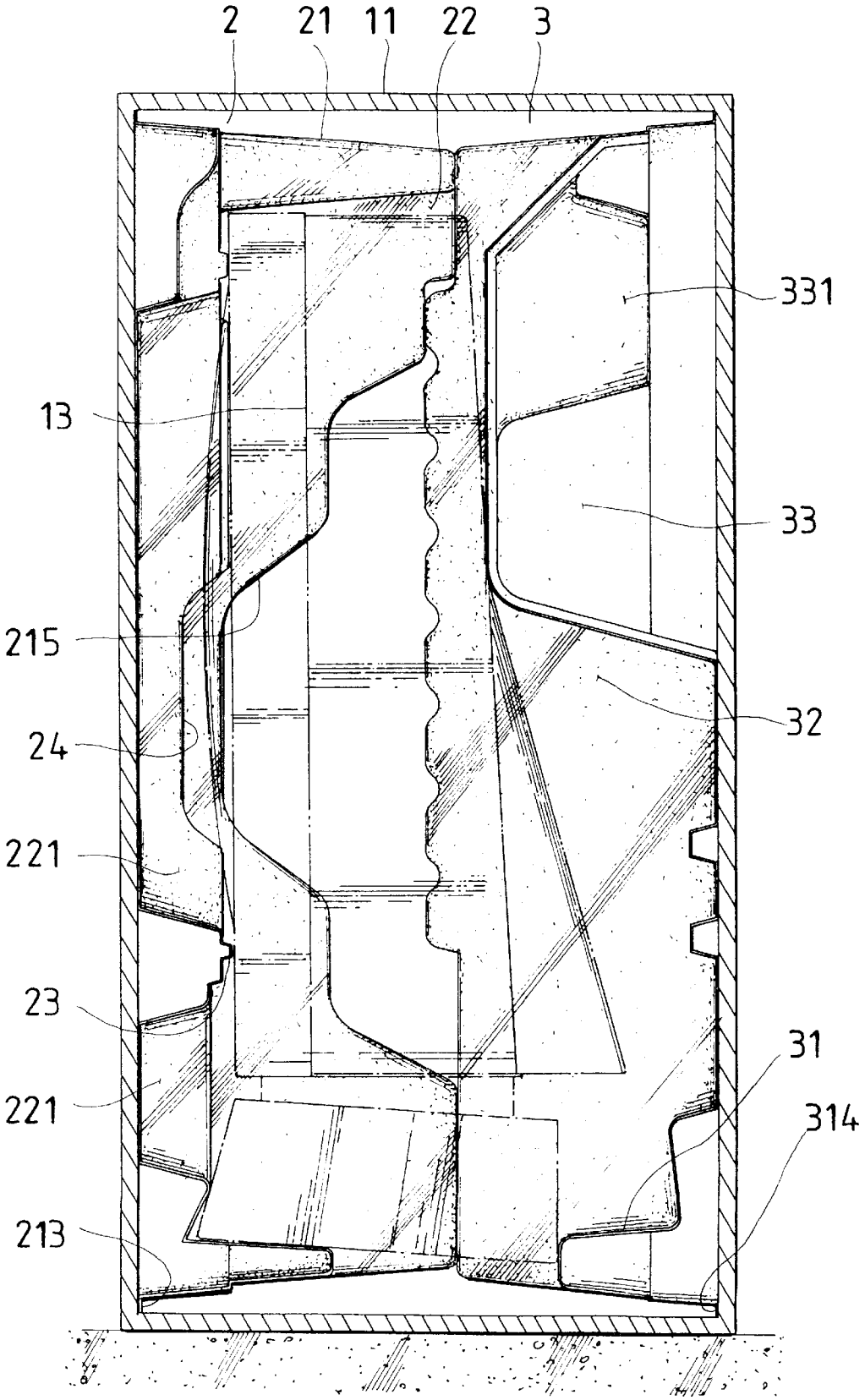
FIG. 3 is a cross-sectional view of the package case for electric appliances and computers of the present invention, showing it standing on a right side.

In using, the lower case 2 is firstly placed in a carton 11, with hands holding the outer side edge 212. The outer side edge 212 can be pressed a little by fingers to shrink inward to let the lower case 2 easily move in the carton 11, and the outer side edge 212 with the curved recesses 214 can let air to flow out when the lower case 2 reaches the bottom of the carton 11 so that the lower case 2 may be placed in the carton without any delay and difficulty. Then a product 13 may be placed in hollow interior 22 of the lower case 2, with the large notches 215 and the shallow recesses 24 useful for fingers to extend therein to place or take out the product 13. Then the product 13 with the lower case 2 may be securely placed in the carton 11. After that, the upper case 3 is laid the product 13 on the lower case 2 in the carton 11, and the wire cord of the product 13 if put through the cut line 341 and through the hole 34 in the upper front hollow interior 33. Next, accessories are placed also in the upper front hollow interior 33 and the upper flaps of the carton 11 are closed on the upper case 2 and sealed, finishing packaging, as shown in FIGS. 2 and 3.

The invention has the following advantages, compared with the conventional one.

1. The upper and the bottom case made of tough thin material such as PP and PET have a plurality of curved recesses formed in four side so that the package case has enough strength and elasticity for protecting precious electric appliances and computers from shocks and hurts during a long period of transportation, securing safety and accuracy of the things packaged.
2. The molds for forming the upper and the lower cases are more simple than those used for the conventional ones needing a large mold a large injecting molding machine, so the package case of the invention is far cheaper to make for a maker.
3. In heating material for injecting molding in the invention, it cannot produce ordor, causing not any influence to workers, while the conventional Styrofoam package case produces odor in manufacturing process, causing negative impact to workers and embarrassment to the neighbors.
4. The upper and the lower thin case can be piled up one by one during manufacturing process, taking small space to store and transport, needing only a space several ten times less than needed for transporting the conventional Styrofoam package case.
5. The hollow package case has a lot of spaces for storing air in the four sides, and after it packages a product and placed in a carton, it has considerable air cushion and elasticity enough to protect the product packaged therein from damage and hurt.
6. The package case of the invention has the hollow interior and innumerable curved recesses formed in the four sides, so after placed in a carton with a product sandwiched between, the package case has elasticity and shock-absorbing function enough to protect the product from shocks received from any directions, thus securing wholeness of the product even in rough movement in transportation, satisfying the standard and demands of makers.
7. The four projecting-up members at the four corners increase the whole strength and buffer elasticity of the lower case, and the large side notches and the shallow recesses in the hollow interior serve for fingers to extend in to take products and increasing stability of the contents packaged.
8. The compressible property of the outer side edges and the projecting edges enable the upper and the lower case shrink to be easily put in a carton, and expand to the normal size after placed therein, and permit air to flow out when it reaches the bottom of the carton so that putting in or taking out the package case together with a product may be quickly and easily effected, without need of other person's help.
9. The hollow interior of the upper case is useful for placing a manual, accessories such as a transformer, a plug, a battery, etc., so when the carton is opened, they are seen at once, easy to check what are they, without possibility of losing them with carelessness if they are placed randomly in the way as in the conventional package cases.

10. The upper case has a cut line and with a hole for a wire cord of product to pass through to be placed on the upper front hollow interior, convenient to package a product in the package case.

11. The upper case has large sloped surfaces formed in the two opposite sides for hands to hold on, and reinforcing buffer elasticity to any directions.

12. The whole package case does not absorb water, without possibility of worsening the accuracy of electronic appliances and components during a long period of transporation, preserving the original quality of the product.

13. It has high cold-resistant property, producing no cracks even in very cold regions, preserving the original quality of products during transporation in cold countries , and having enough strength and shock-absorbing function.

14. It has more elegant appearance and feeling than the conventional ones, increasing worthiness of a product it packages, and enhancing its added value.

15. The four corners have an obtuse angle, not very sharp, diminishing shocks received there, alleviating and dispersing shock force, increasing its practicality.

16. It forms a large air cushion body after placed in a carton, enduring shocks received and protecting the product contained in it from any damage or hurt.

What is claimed is:

1. A package case for electric appliances and computers comprising:

an upper case integrally formed of an injection molded plastic material, said upper case including four sides and a bottom, said upper case having an interior space defined by said four sides and said bottom for receiving an upper portion of a product therein; and, a lower case integrally formed of an injection molded plastic material, said lower case including four sides and bottom, said lower case having an interior space defined by said four sides and said bottom for receiving a lower portion of the product therein, said four sides of both said upper and lower cases respectively having an inner wall and an outer wall forming an air cushion space therebetween, said inner wall and said outer wall having a plurality of longitudinally spaced curved recesses formed therein to provide reinforcement of said inner and outer walls, said outer wall having a step-shaped contour intermediate upper and lower edges thereof for further reinforcement thereof and a protruding portion at one of said upper and lower edges, said protruding portion of said outer wall of each of said for sides respectively forming a protruding circumferential edge of said upper and lower cases, said package case thus having enough strength and buffer elasticity for wrapping the product within a carton and enduring shocks coming from any direction to protect the product wrapped therein from damage.

2. The package case for electric appliances and computers as claimed in claim 1, wherein said lower case has a plurality of recesses formed in the bottom thereof and a plurality of upwardly projecting strip shaped hollow projections respectively formed near each said recess for supporting fragile portions of the product laying thereon.

* * * * *